United States Patent [19]

Proctor

[11] 4,274,677

[45] Jun. 23, 1981

[54] MINERAL CUTTER PICK ARRANGEMENT

[75] Inventor: Sidney E. Proctor, Amersham, England

[73] Assignee: Pars Engineering Company Limited, London, England

[21] Appl. No.: 41,484

[22] Filed: May 22, 1979

Related U.S. Application Data

[63] Continuation-in-part of Ser. No. 817,155, Jul. 20, 1977, abandoned.

[30] Foreign Application Priority Data

| | | | |
|---|---|---|---|
| Jul. 23, 1976 | [GB] | United Kingdom | 30908/76 |
| Dec. 7, 1976 | [GB] | United Kingdom | 51077/76 |
| May 11, 1977 | [GB] | United Kingdom | 19856/77 |
| May 26, 1978 | [GB] | United Kingdom | 23129/78 |

[51] Int. Cl.[3] ..... E21C 35/18

[52] U.S. Cl. ..... 299/92; 37/142 A; 175/413

[58] Field of Search ..... 299/91–93; 175/413; 37/142 A, 142 R; 407/117, 118

[56] References Cited

U.S. PATENT DOCUMENTS

| | | | |
|---|---|---|---|
| 2,167,425 | 7/1939 | Page | 37/142 A |
| 3,001,591 | 9/1961 | Johnson | 299/91 X |
| 3,085,635 | 4/1963 | Livermore | 299/91 X |
| 3,297,364 | 1/1967 | McPherson | 299/91 X |
| 3,751,115 | 8/1973 | Proctor | 299/92 |
| 3,773,114 | 11/1973 | Griffin | 37/142 A X |
| 3,820,849 | 6/1974 | Lundstrom et al. | 175/413 X |

FOREIGN PATENT DOCUMENTS

| | | | |
|---|---|---|---|
| 1266137 | 3/1972 | United Kingdom | 299/93 |

*Primary Examiner*—Ernest R. Purser

[57] ABSTRACT

The specification describes a mineral cutter pick arrangement in which the cutter pick has a body member with a cutter tip formed at one end thereof. The widest dimension of the cutter pick transverse to the forward direction of movement of the cutter pick adjacent the cutter tip being greater than the corresponding dimension of a cutter pick holder on which, in use, the pick is mounted; the cutter pick body member being formed at one end with a top member extending rearwardly of the body member, wherein the rearmost surface of said top member extends from the undersurface of said top member at an angle which diverges from the normal to the undersurface of said top member.

20 Claims, 18 Drawing Figures

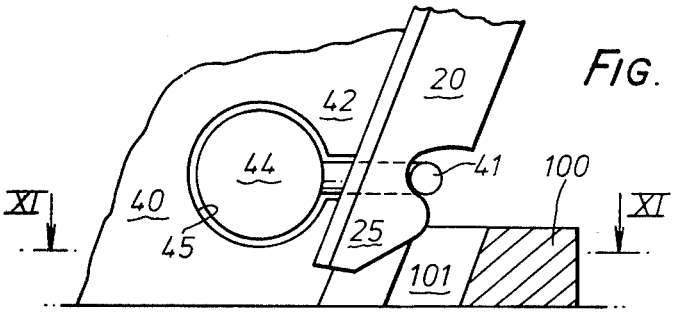
FIG. 10.
FIG. 11.
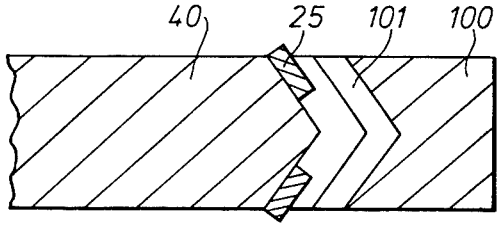
FIG. 12.
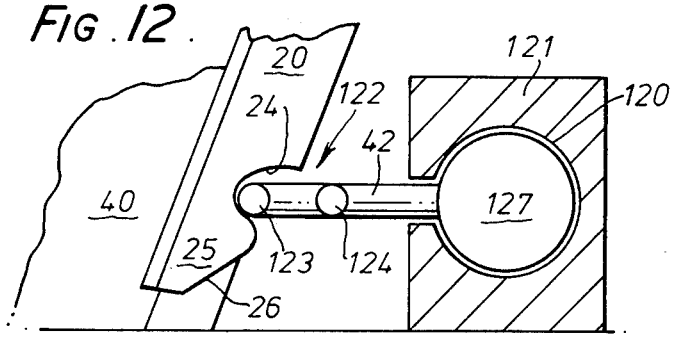
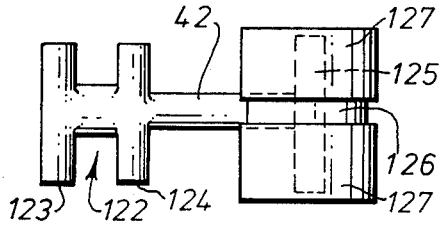
FIG. 13.

MINERAL CUTTER PICK ARRANGEMENT

This application is a continuation in part of Ser. No. 817,155 filed July 20, 1977 and now abandoned.

The invention relates to mineral cutter picks and to arrangements of mineral cutter picks.

Known mineral cutter picks, for example, coal cutter picks generally provide a pick located in a pick block, for example a cutter chain link, shearer drum or pin on block.

The known arrangements of mineral cutter picks are costly to produce and moreover are difficult and expensive to replace.

The present invention includes among its objects the provision of a form of mineral cutter pick, and of a mineral cutter pick arrangement meeting or alleviating the problems found with known arrangements.

One aspect of the invention provides a mineral cutter pick, having a body member with a cutter tip formed at one end thereof the widest dimension of the cutter pick transverse to the forward direction of movement of the cutter pick adjacent the cutter tip being greater than the corresponding dimension of a cutter pick holder, on which, in use, the pick is mounted the cutter pick body member being formed at said one end with a top member extending rearwardly of the body member, and wherein the rearmost surface of said top member extends from the under-surface of said top member at an angle which diverges from the normal to the under-surface of the said top member.

The undersurface of the top member is preferably engageable with the uppermost surface of the cutter pick holder by which, in use, the cutter pick is carried. The under surface of the top member to the rear of said body member may be recessed, preferably slotted.

Alternative forms of the cutter pick provide that the under surface of the top member to the rear of the body member may have projecting means, such as a bar extending thereacross, one or more spigot members formed thereon; one or more pins insertable through apertures formed in the top member to project from the under surface of the top member; or one or more screw members threadably engageable in apertures formed in the top member to project from the under surface thereof.

The bottom section of the body member may be bifurcated, the bifurcated section leading to a recessed part of the body member. With advantage the leading surfaces of the bifurcated section of the body member leading to the recessed part are sloped.

A second aspect of the invention provides a mineral cutter pick arrangement comprising a cutter pick holder with a leading edge for supporting a cutter pick having a body member with a cutter tip formed at one end thereof wherein the widest dimension of the cutter pick transverse to forward direction of movement of the cutter pick adjacent the cutter tip is greater than the corresponding dimension of the cutter pick holder, the cutter pick body member is formed at said one end with a top member extending rearwardly of the body member, and wherein the rearmost surface of said top member extends from the under-surface of said top member at an angle which diverges from the normal to the under-surface of the said top member.

The leading edge of the cutter pick holder may be formed with a projecting surface which abuts against the re-entrant surface formed on the rear face of the cutter pick. Preferably said projecting surface is triangular in section and the re-entrant surface of the rear face of the cutter pick is shaped to conform thereto.

The cutter pick is with advantage formed of a body member carrying at said one end a top member extending rearwardly of the bottom member, the top member and the top of the cutter holder having interengaging means which act to hold the uppermost part of the cutter pick against the cutter pick holder.

The under surface of the top member of the cutter pick may be, for example, recessed to receive a projection formed on the upper surface of the cutter pick holder. Preferably the recess formed in the under surface of the top member is a slot for receiving a bar formed on the upper surface of the cutter pick holder.

Alternatively the top of the cutter pick may be provided with means projecting from the under surface thereof to engage in a recess formed in the upper surface of the cutter pick holder. The projecting means may comprise a bar for engaging in a slot in the upper surface of the cutter pick holder, or one or more spigot members formed on the under surface of the top member and engageable in apertures formed in the upper surface of the cutter pick holder. Alternatively the projecting means may comprise pins insertable through apertures formed in the top member of the cutter pick and engageable in recesses formed in the under surface of the cutter pick holder, or one or more screw members threadably engageable in apertures formed in the top member to project from the under surface thereof and engageable in threaded apertures formed in the upper surface of the cutter pick holder.

The bottom section of the body member may be bifurcated, the bifurcated bottom section leading to a recessed part of the body member, the leading surfaces of the bifurcated bottom section being sloped.

The cutter pick arrangement preferably comprises retaining means provided to retain the cutter pick, on the cutter pick holder, the retaining means comprising a resilient body held in a fixed position for supporting a rigid body extending therefrom to engage the cutter pick behind the leading edge thereof.

The resilient body may be located in an aperture in the cutter pick holder and the rigid body may comprise a bar carrying a first part for engaging the cutter pick behind the leading edge thereof.

The resilient body may alternatively be located in an aperture formed in a member mounted in front of the leading edge of the cutter pick and the rigid body may comprise a bar carrying a first part for engaging the cutter pick.

Said first part preferably locates in said recess formed in the cutter pick body.

Advantageously the rigid body carries a second part engageable with a tool to enable said first part to be pulled forwardly of the cutter pick so as to enable release of the cutter pick from a cutter holder.

The cutter pick arrangement may include arrester means located in front of the cutter pick and having a surface conforming to the shape of the front surface of the cutter pick opposed thereto.

The cutter pick holder is preferably provided with conduit means located behind the cutter pick by which water may be provided at the cutting surface of the cutter tip.

Said conduit means preferably comprises a reinforced metal pipe extending across and welded to the rear surface of the cutter holder.

Various illustrative embodiments of the present invention will now be described with reference to the accompanying drawings in which:

FIG. 10 is a partial side elevation partly in section of the modified arrangement embodying the invention;

FIG. 11 is a sectional plan view drawn on the lines XI—XI of FIG. 10;

FIG. 12 is a partial side view, partly in section, of a further coal cutter pick arrangement embodying the invention;

FIG. 13 is a plan view of retaining means used in the embodiment of FIG. 12.

Figure 1:
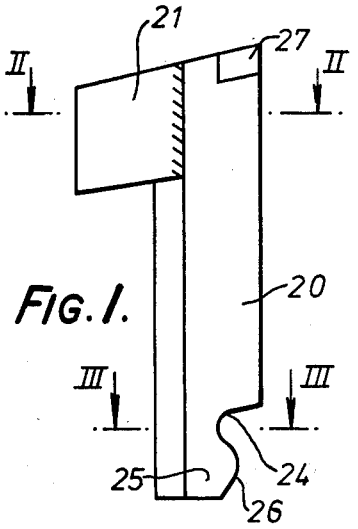
FIG. 1 is a side view of one form of a coal cutter pick embodying the invention.
Figure 2:
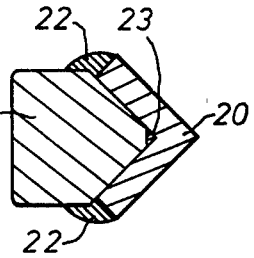
FIGS. 2 and 3 are sectional views of the pick drawn on the lines II—II and III—III respectively of FIG. 1.
Figure 3:
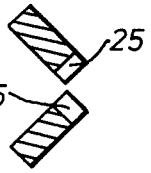

With reference now to FIGS. 1, 2 and 3 of the drawings it will be seen that the coal cutter pick has a body member 20 and a top member 21. The body member 20 is V-shaped in section (see FIGS. 2 and 3) and the top member 21 is shaped (as can be seen from FIG. 2) to conform to the re-entrant rear surface of the body member 20. The top member 21 is welded into the position shown as for example at 22 and 23.

The leading edge of the bottom of the body member 20 is recessed as shown at 24 and is bifurcated to form legs 25. The front edges 26 of the legs 25 passing from the bottom-most edge of the body 20 to the recess 24 are sloped as shown. The uppermost end of the leading edge of the body member 20 is provided with a cutter tip 27 which may be of tungsten carbide or a suitable hard metal deposit. This tip is preferably braised or welded into a recess formed in the leading uppermost portion of the body member 20.

Various modifications to the arrangement shown in FIGS. 1, 2 and 3 (see for example FIGS. 4, 5, 6 and 9) may be proposed. The uppermost portion 21 of the cutter pick may be formed as a single unit welded directly on to the top of a piece of angle iron forming the body member 20. The cutter tip 27 may be welded or braised into position on the top of the cutter body or top member 21. In fact the cutter tip may be formed as a single unit with the top member and be fixed in position on the top of the cutter body 20.

Figure 4:
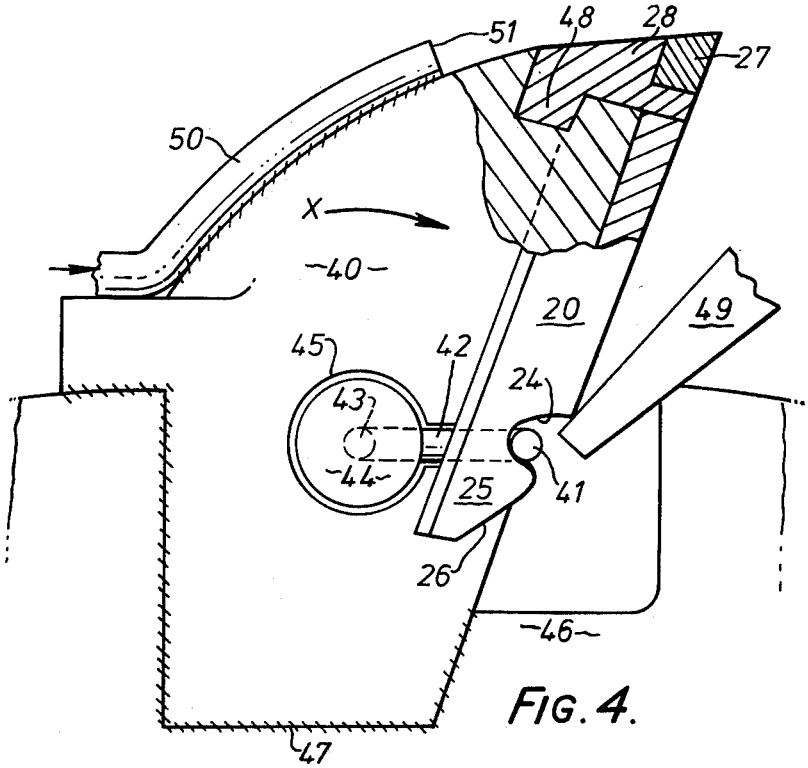
FIG. 4 is a side elevation partly in section of a second form of coal cutter pick in a coal cutter pick arrangement embodying the invention and mounted on a shearer drum.

With reference now to FIG. 4 the cutter pick arrangement shown therein is seen to include a pick holder 40 arranged to move, in use, in the direction of the arrow X and supporting on its front edge a cutter pick having a tunsten carbide cutter tip 27 mounted on the leading edge of a top member 28 as shown.

The recess 24 at the lowermost part of the cutter pick body 20 receives a cross-bar 41 of a T-shaped bolt the shank 42 of which is secured at its other end to a shank pin 43 surrounded by a resilient neoprene or rubber plug 44 located in a hole 45 formed in the holder 40 as shown.

The neoprene plug 45 is surrounded by a metal cover shell not shown in FIG. 4.

The cutter pick holder 40 is carried by a carrier 46 which, as shown in FIG. 4, may be for example a shearer drum. The lowermost part of the pick holder is shaped to conform to a corresponding hole formed in the carrier 46 and the holder is welded into position as shown at 47.

The pick holder 40 is machined to receive on its leading edge the body 20 of a cutter pick, and its top surface has an aperture machined in it which receives a projecting spigot 48 formed on the under surface of the top 28 of a cutter pick.

The downwardly projecting spigot 48 received in the aperture formed in the top of the cutter pick holder 40 ensures that the uppermost part of the cutter pick is held firmly on the holder. This particular arrangement ensures that if the direction of rotation of the carrier 46 is reversed the cutter pick is not carried away from the leading edge of the cutter pick holder.

It is envisaged that in production the arrangement of FIG. 4 would provide a pair of spigot members 48 located beside one another in a direction transverse of the forward direction of movement of the holder 40. This modification would increase the resistance of the arrangement to forces tending to twist the cutter pick off the holder.

In use when the pick holder has been fixed in position on the carrier 46 (which may at any desired angle) the cutter pick body is placed on the leading edge of the holder 40 and located by being pushed in a downward direction with the aid of for example a rawhide hammer. This causes the cross-bar 41 to ride up the sloped leading edges 26 of the bifurcated section and fall into the recess 24.

Removal of the cutter pick from the holder 40 is effected by the use of a tool, as shown at 49 in FIG. 4, which pivots forwardly of the cutter pick.

The rearmost surface of the holder 40 is provided with a reinforced metal conduit 50 extending as shown to a position immediately behind the top of the cutter pick and terminates in a nozzle 51. When the cutter pick is used water is passed along the conduit 50 to spray from the nozzle 51 over coal being cut by the cutter pick. This supply of water reduces the level of coal dust in the atmosphere in which the arrangement is being used.

Alternatives to the arrangement shown in FIG. 4 will now be described with reference to the remaining Figures.

Figure 5:
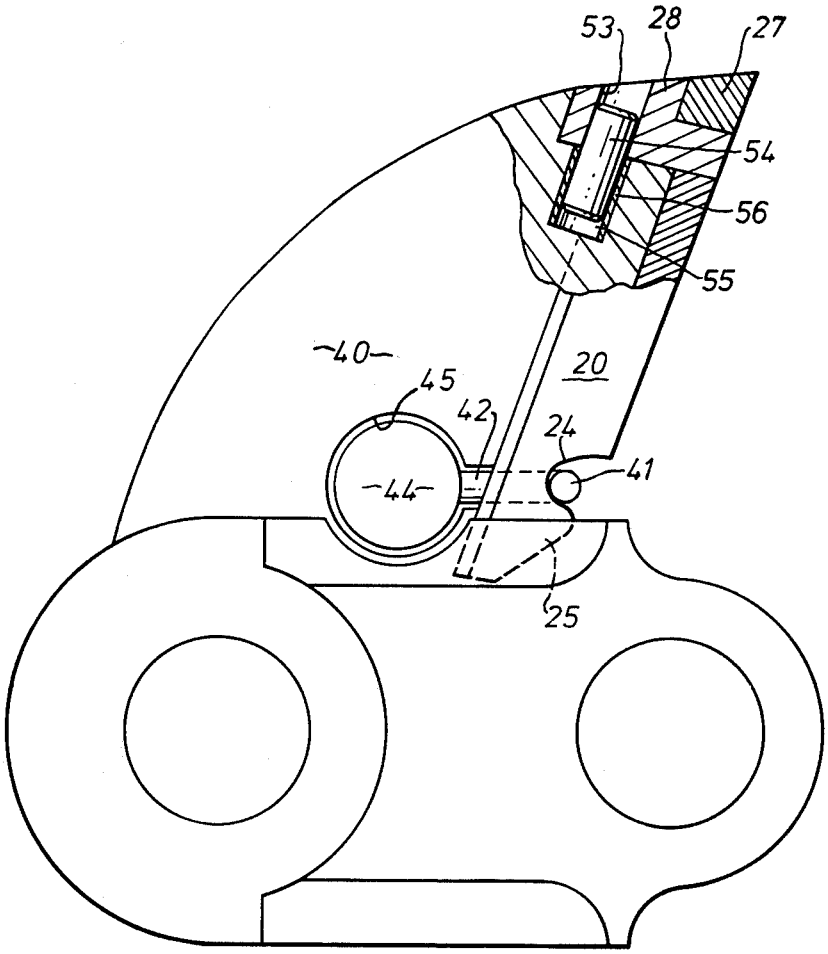
FIG. 5 is a side elevation partly in section of another form of coal cutter pick in a further arrangement embodying the invention and mounted on a link of a cutter chain.

FIG. 5 shows a cutter pick arrangement embodying the present invention mounted on a link of the cutter chain. Those parts of this embodiment which correspond to parts of the embodiment described with reference to FIG. 4 are given the same reference numerals.

As can be seen the arrangement shown in FIG. 5 differs from that shown in FIG. 4 in the way the cutter pick is attached, at its upper end, to the cutter holder 40. In the arrangement of FIG. 5 an aperture 53 is provided extending through the top member 28 of the cutter pick through which a roll pin 54 is punched to engage in a hole 55 formed in the upper part of the cutter holder 40. The pin 54 is a friction fit in the aperture 51 and is located in a hole 55 by means of a resilient bush 56 as shown.

When the cutter pick is to be located on the front of the cutter holder it is placed on the leading edge of the holder and hammered down into position such that the projection 41 of the retaining means locates in the recess 24. The roll pin 54 which has been placed as shown in the aperture 53, engages in a bush in the hole 55.

As a modification of the arrangement of FIG. 5 it is envisaged that a pair of pins may be provided located beside one another in a direction transverse of the holder 40. This modification increases the resistance of the arrangement to forces tending to twist the cutter pick off the front of the holder.

Figure 6:
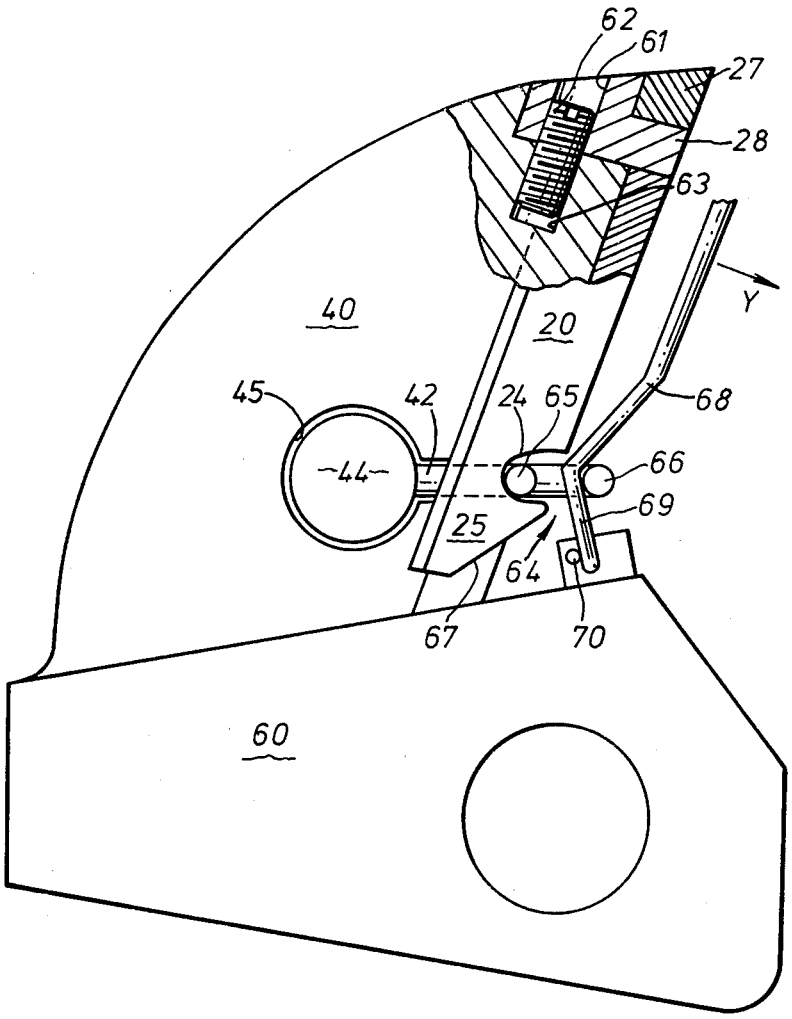
FIG. 6 is a side elevation partly in section of yet another form of coal cutter pick in a further arrangement embodying the invention and mounted on a pin-on block.

The embodiment shown in FIG. 6, in which the cutter holder 40 is mounted on a pin-on block 60, has parts in common with the embodiments of FIGS. 4 and 5 which again are given the same reference numerals.

The top portion 28 of the cutter pick shown in FIG. 6 is provided with a threaded aperture 61 in which a screw or bolt member 62 is received. Member 62 may be rotated to pass partially through the aperture 61 and engage in a threaded aperture 63 formed in the upper surface of the cutter pick holder. As with the arrangement of FIG. 5 two such screws or bolt members may be provided beside one another in a direction extending transversely of the cutter pick holder to prevent the cutter pick twisting in use.

In the arrangement of FIG. 6 the shank 42 of the retaining means is connected to a member 64 having a first part 65 received in the recess 24 on the front of the cutter pick body and a second part 66 located in front of the first part 65 and extending on either side of that first part.

In use the first part 65 engages in the recess 24 formed in the front surface of the cutter pick body after passing along a sloping surface 67 from the bottom edge of the cutter pick.

With this arrangement, again in use the cutter pick is positioned on the holder 40 by first placing the body of the retaining means in the hole 46 in the cutter holder such that the extension 42 leads forwardly. The rear surface of the cutter pick body is then placed on the front, V-shaped surface of the cutter holder 40 and the cutter pick hammered down such that the member 65 rides up on the surface 67 until it falls into the recess 24. The shape of the leading edge 67 (which differs from that shown at 26 in FIGS. 1, 4 and 5) formed on the legs of the bifurcated bottom section of the cutter pick body ensures that the first part 65 remains retained in the recess 24 even if the neoprene plug located in the body of the holder weakens allowing the first part 65 to move in the recess 24.

Removal of the cutter pick with the arrangement shown in FIG. 6 is effected by the use of a tool such as that shown at 68 one end of which is bifurcated to form two cranked arms 69. When a cutter pick is to be removed the tool 68 is positioned, as shown in FIG. 6, such that the lower end of each of the cranked arms 69 engages the end of a pin or front surface of another part 70 whilst the arms themselves pass behind the ends of the second member 66.

The remote end of the tool 68 is then pulled in the direction of the arrow Y causing the tool to pivot around the ends of the cranked arms 69 and engage the rear surface of the member 66 pulling the shank 42 forwardly such that the member 65 is disengaged from the recess 24. As soon as the tool 68 has been rotated sufficiently in the direction of the arrow Y to move the member 65 out of the recess 24 the cutter pick may be lifted away from the holder.

Figure 7:
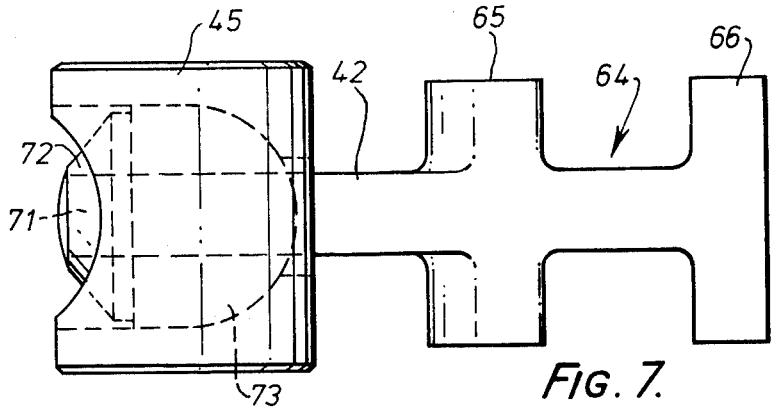
FIGS. 7 and 8 are plan and side views respectively of a retaining means used in the arrangement of FIG. 6.
Figure 8:
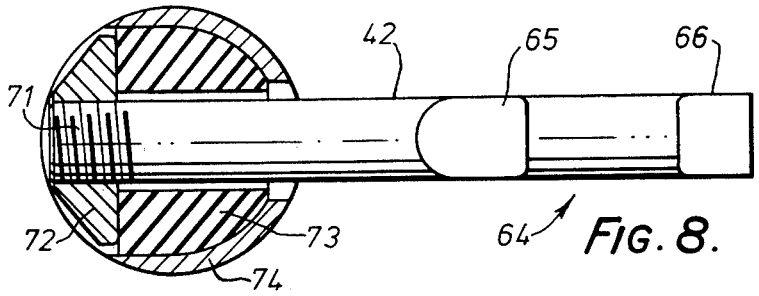

FIGS. 7 and 8 show the retaining means used in FIG. 6 in greater detail.

As can be seen the shank 42 extends through the plug member 45 and terminates at 71 in a screw threaded part engaging in a nut or plate 72 located to one side of the neoprene plug 73, housed in a metal cover shell 74.

In this arrangement the plug 73 is flexible enough to permit sufficient movement of the shank 42 to allow member 65 to be lifted out of the recess 24 and so enable removal of the cutter pick from the holder 40.

Figure 9:
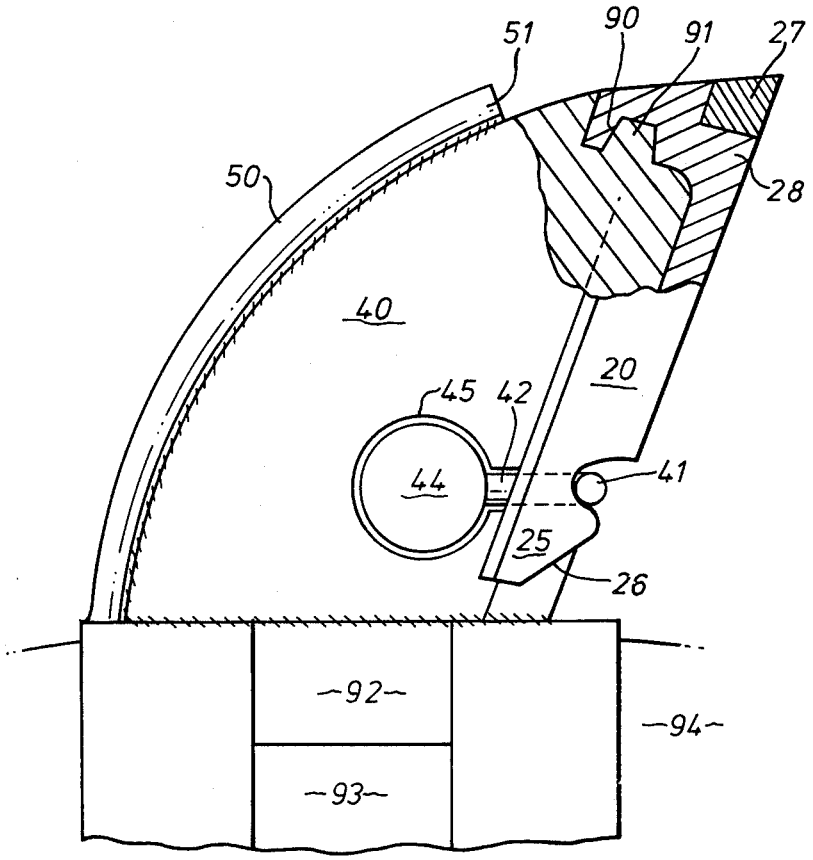
FIG. 9 is a side elevation partly in section of yet another form of coal cutter pick in another arrangement embodying the invention and mounted by a stub-shaft on a shearer drum.
Figure 14:
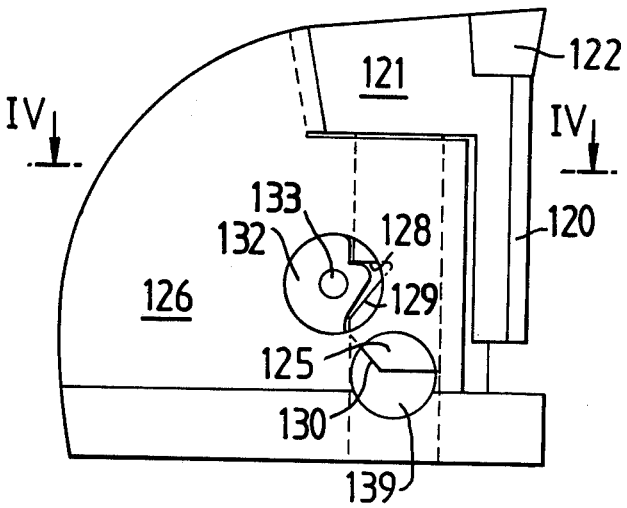
FIG. 14 is a side view of a further coal cutter pick arrangement embodying the present invention.
Figure 15:
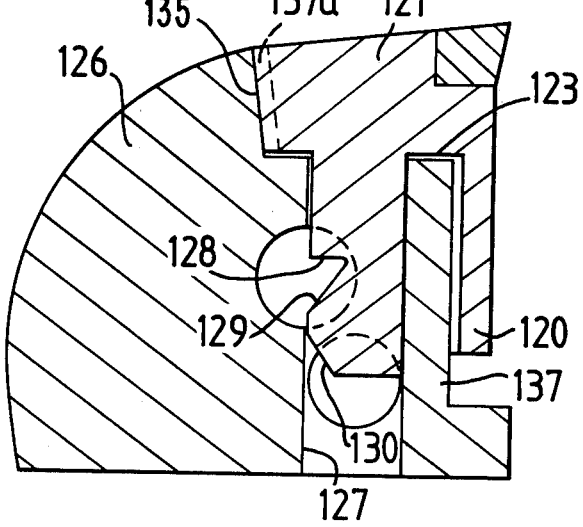
FIG. 15 is a sectional side elevation of the arrangement of FIG. 14.

FIG. 9 shows yet another cutter pick arrangement embodying the present invention and those parts of it which correspond to parts already described are given the same reference numerals.

As shown in FIG. 9 the top 28 of the cutter pick is formed on its under surface with a recessed slot 90 extending transversely of the forward direction of motion of the cutter holder.

This slot receives a bar 91 formed as shown in the upper surface of the cutter holder.

The bottom end of the cutter holder 40 shown in FIG. 9 is shaped so as to be received in a conventional pick holder.

This particular feature enables the ready replacement of picks commonly in use at present by picks modified in the forms now proposed.

In particular the holder of FIG. 9 is provided with a stub-shaft 92 for locating an existing pick hole 93 which may be rectangular or circular. The pick hole 93 is shown to be formed in a shearer drum 94 but any alternative carrier may in fact be used.

Various modifications may be made to the arrangements described above without departing from the scope of the present invention.

For example FIGS. 10 and 11 show an arrangement including arrester means 100 located immediately in front of the leading edge of the cutter pick 20 as shown. The arrester means has a V-shaped slot formed by surfaces 101 which conform to the shape of the cutter pick body 20.

The particular advantage of this arrangement is that should the retaining means holding the bottom portion of the cutter pick on the leading edge of the cutter holder become weakened, in use, tilting of the cutter pick about its upper end (such that its lower end moves forward from the face of the cutter holder) is prevented as the front surfaces of the cutter body come into contact with the surfaces 101 of the arrester means.

FIGS. 12 and 13 show a modified form of retaining means mounted forwardly of the cutter pick. With this arrangement the plug member 45 of the retaining means is located in a hole 120 formed in a block 121 mounted in front of the front surface of the cutter pick body 20.

The shank 42 extends rearwardly towards the cutter pick and terminates in a body member 122 formed with the first extension 123 received in the recess 24 formed in the cutter pick body and a second member 124 located in front of the member 122 and extending transversely of the direction of motion of the cutter pick.

With this arrangement, as can be particularly seen in FIG. 13, the plug 45 is formed in a modified manner to that described with reference to FIGS. 7 and 8, in particular the shank 42 is joined to a shank pin 125 completely housed within a neoprene or rubber bush 126. The rubber bush 126 is covered by two metal half shelves 127 as shown.

The retaining means shown in FIGS. 12 and 13 may be removed from the recess 24 by the use of, for example, a tool such as that described in the arrangement of FIG. 6.

The modified form of coal cutter pick arrangement shown in FIGS. 14 to 18 includes a body member 120, formed integrally with a top member 121 which extends rearwardly therefrom.

The uppermost end of the leading edge of the cutter pick is provided with a cutter tip 122 which may be of tungsten carbide or other suitable hard metal deposit. This tip is preferably brazed or welded into a recess formed into the leading uppermost portion of the cutter pick.

Various modifications may be made to the arrangement of cutter pick. The uppermost portion of the cutter pick may be formed as a separate unit welded directly on to the top of the body member 120. The cutter tip 122 may be welded or brazed into position on the top of the cutter pick. The cutter tip 122 may be formed as a single unit with the top member and fixed with the top member into position on the top of the cutter body.

The lowermost surface 123 of the top member 121 is formed with a cylindrical bar 125 which, when the pick is in position on a holder 126, extends into a hole 127 formed therein. The bar 125 is preferably circular in cross-section, although the other shapes, in cross-section, may be used. The bar is provided with a cutout as shown formed by a first surface 128 extending generally normally of the axis of the bar and the second surface 129 which slopes from the innermost end of the surface 128 to the rearmost surface of the bar.

The bottom end of bar 125 is cut away shown at 130.

A recess 131 in the pick holder carries a neoprene or other elastomeric material, plug 132 which is formed on a steel pin 133 as shown. Plug 132 juts into the aperture 127 and, in use, abuts the cut-out formed by the surfaces of 128 and 129 in the bar 125.

The rearmost surface 134 of the top member 121 is angled to the lowermost surface 123 as shown and, in use, abuts against a surface 135 of the pick holder.

The leading edge 137 of the pick holder 126 is shaped to conform to the arcuate surface at the rear of body member 120.

The rearmost surface 134 of the top member 121 is provided with a land **137*a* which is received in a slot 138 formed in surface 135. It will be appreciated that the arrangement of land 137*a* in slot 138** prevents movement of the pick relative to the pick holder in a direction transverse to the direction movement of the pick in use.

To place the cutter pick of a pick holder it is necessary merely to locate the bar 125 to the upper part of hole 127 and then push the cutter pick onto the pick holder. The arcuate rear surface of the body member 120 aligns itself with the similarly shaped leading edge 138 of the pick holder 126 and the bar 125 slides down the hole 127 until its bottom end reaches the neoprene plug 131. The cutter pick may then be hammered down such that the neoprene plug 131 is pushed aside, passing up surface 130 and along the side of the bar 125 until it enters the cut-out formed by the surfaces 128 and 129. At the same time the rearmost surface of 134 of the top member 121 is forced into abutment with the surface of 135 of the pick holder, the land **137*a* entering the slot 138 in surface 135. This particular arrangement tends to wedge the pick firmly on the holder, the camming surfaces 134 and 135 acting to push the bar 125 against the leading edge of the hole 127**.

To enable release of the pick from the pick holder, for example, when it is desired to replace the cutter pick the pick holder is provided with an aperture 139 as shown which opens into aperture 127 through which is possible to insert a tool to bear against the bottom surface of the bar 125 and force the bar upwardly. When this is done the neoprene plug 131 rises up surface 129 and enables the pick to be removed from the pick holder.

Figure 18:
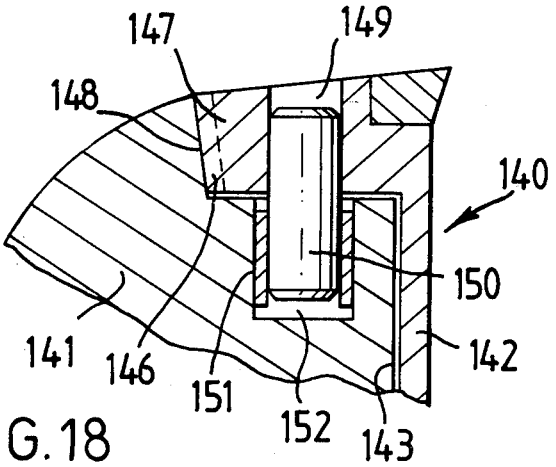
FIG. 18 is a sectional side elevation of another arrangement embodying the invention.

FIG. 18 shows an embodiment of the invention in which the pick 140 is located on a holder 141 the body 142 of the pick being re-entrant, preferably V-shaped and being located on the leading edge 143 of the pick cutter which is shaped to conform to it.

Figure 16:
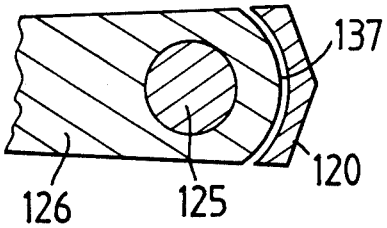
FIG. 16 is a sectional view drawn on the lines IV—IV of FIG. 14.
Figure 17:
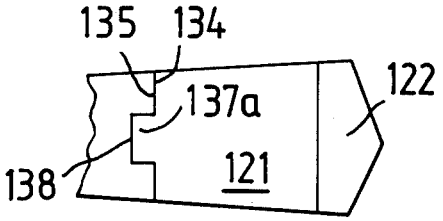
FIG. 17 is a partial plan view of the arrangement of FIG. 14.

As in the arrangements of FIGS. 14 to 17 the top member 144 of the pick has a rear surface 145 which extends at an angle of approximately 10° to the normal from its under surface and has a land 146 engaging in a slot 147 formed in the surface 143 of the holder 141 (as in FIG. 16).

The lower end of holder 142 may be bifurcated and held in position by a resilient member carried by the pick holder.

In the arrangement of FIG. 18 the top member 144 has an aperture 149 in which a pin 150 is a friction fit. In use pin 150 enters and is held in a resilient steel bush 151 in a hole 152 in the holder.

It will be seen that, as in the arrangement of FIGS. 14 to 17, when the pick is hammered down on the holder the camming action of the surfaces 145 and 148 forces the pin 150 to wedge it against the front of the hole 152.

It will be appreciated that the described arrangements provide cutter pick arrangements in which all the cutting forces encountered under normal cutting conditions are absorbed by the cutter pick and in fact because of its particular shape and the shape of the leading edge of the holder 40 most of these forces encountered by the cutter pick are transmitted directly through it to the cutter pick holder where they act to compress the material of the holder. This feature provides that the life of the pick holder may be considerably extended compared with known forms of pick holder in which such forces act to elongate or expand the holder.

With all the above described arrangements the cutting tip is as wide as possible whilst at the same time the overall dimensions of the arrangement are relatively small with the result that the arrangement is economical to manufacture.

The simplicity of the design has the result that the holder 40 is economical to make. The width of the holder is such that it does not extend on either side of the vane of the shearer drum or other carrier on which it is mounted and it is an important advantage of the design now described that the pick holder is not wider than the width of the cutter pick which it supports (at least in the region where the cutter pick cuts into a mineral) with the result that the holder 40 is not scrubbed by any mineral being cut.

In conventionally known cutter pick arrangements the retaining means holding the cutter pick on the pick holder are normally positioned in front of the cutting edge of the pick whereas in the presently described arrangements the retaining means may lie wholly behind the leading edge of the pick with the result that a more rigid fixture of the cutter pick on the holder is achieved.

Finally it will be appreciated that various modifications may be made to the above described embodiments without departing from the scope of the present invention.

I claim:

1. A mineral cutter pick arrangement comprising a cutter pick holder having an elongated leading edge and an upper surface, a cutter pick comprising a body member having a leading edge, a rear surface, an upper end and a bottom end, the widest dimension of the cutter pick body member transverse to the forward direction of movement of the cutter pick at least adjacent the upper end being greater than the corresponding dimension of the cutter pick holder, the cutter pick body member being formed at said upper end with a top member having a rearmost surface and an under-surface, said top member extending rearwardly of the leading end of said body member, the rearmost surface of said top member being at an angle which diverges from the normal to the under-surface of the said top member to abut against a surface of the pick holder which conforms to the shape of said rearmost surface, the upper surface of said holder and the lower surface of said top member being provided with interengaging means enabling the cutter pick body member to be located on the holder with said rearmost surface in abutment with said conforming surface of said holder and a cutter tip secured within a recess with said top member along the leading edge thereof.

2. An arrangement according to claim 1, wherein the rearmost surface of the top member extends at an angle diverging from the normal to the under-surface of the top member of approximately 10 degrees and abuts against a surface of the holder upstanding from the upper surface thereof.

3. An arrangement according to claim 2, wherein said rearmost surface of the top member is provided with means for engaging said conforming surface of the pick holder.

4. An arrangement as claimed in claim 3 wherein the said means comprises a land formed on the rearmost surface of the top member for engaging a slot formed in the conforming surface of the pick holder.

5. A mineral cutter pick arrangement according to claim 4, said interengaging means comprising a cylindrical bar formed on the under-surface of the top member and engaging a corresponding aperture formed in the pick holder.

6. An arrangement according to claim 5 wherein the bar is circular in cross-section.

7. An arrangement according to claim 6, wherein said bar extends from top member at least as far as does said body member.

8. The arrangement of claim 7, wherein the rear surface of the body member is shaped to conform to the leading edge of the pick holder.

9. The arrangement of claim 5, including further interengaging means ensuring the location of said bar in said aperture.

10. The arrangement of claim 9, wherein said further interengaging means comprises a resilient member located in the pick holder engaging a cut-out portion of said bar.

11. The arrangement of claim 10 and including means enabling release of the cutter pick from the holder, said means comprising an aperture formed in the pick holder to intersect said firstmentioned aperture to allow the insertion of a tool therein to force said bar from said firstmentioned aperture.

12. An arrangement according to claim 1, wherein the rear surface of the body member is shaped to conform to the leading edge of the pick holder.

13. A mineral cutter pick arrangement comprising a cutter pick holder having an elongated leading surface and an upper surface, and a mineral cutter pick having a body member with a leading edge and a rear surface, the body member being formed with a cutter tip at one end of said leading edge and with a top member extending rearwardly of said rear surface, the bottom surface of said top member and the upper surface of said holder being provided with interengaging means enabling the pick to be located on the holder with the rear surface of the pick in abutment with the leading surface of said holder, the rear surface of the body member being V-shaped in section and the leading surface of the body member is shaped to conform thereto, and the widest transverse dimension of said body member being equal to or greater than the corresponding dimension of the top member.

14. The arrangement of claim 13, in which said interengaging means comprises a recess formed in the under-surface of the top member to the rear of said body member, and a projection formed on the upper-surface of the holder.

15. The arrangement of claim 13, in which said interengaging means comprises projection means formed on the under-surface of the top member to the rear of the body member for engaging recess means formed in the upper-surface of the holder.

16. The arrangement according to claim 13, in which the bottom section of the body member is bifurcated, the bifurcated section leading to a recessed part of the body member, and in which the leading surfaces of the bifurcated section of the body member slope toward said recessed part of the body member.

17. The arrangement of claim 13, in which retaining means are provided to retain the cutter pick on the cutter pick holder, said retaining means comprising a resilient body held in a fixed position and supporting a rigid body extending therefrom to engage the cutter pick behind the leading edge thereof.

18. The arrangement of claim 17, in which the resilient body is located in an aperture in the cutter pick holder, and in which the rigid body comprises a bar carrying a first part for engaging the cutter pick behind the leading edge thereof in said recessed part of said body.

19. The arrangement of claim 17, in which the resilient body is located in an aperture formed in a member mounted in front of the leading edge of the cutter pick, and the rigid body comprises a bar extending rearwardly therefrom towards the cutter pick, and supporting a first part for engaging the cutter pick in said recessed part of said body.

20. The arrangement of claim 18 or claim 19, in which the rigid body supports a second part engageable with a tool to enable said first part to be pulled forwardly of the cutter pick so as to enable release of the cutter pick from a cutter holder.

* * * * *